US005985048A

United States Patent [19]

Wahlert et al.

[11] Patent Number: 5,985,048

[45] Date of Patent: Nov. 16, 1999

[54] METHOD FOR DEVELOPING AN ENHANCED OXIDE COATING ON A COMPONENT FORMED FROM STAINLESS STEEL OR NICKEL ALLOY STEEL

[75] Inventors: Raymond W. Wahlert, Lakeside, Mont.; Arthur H. Tuthill, Blackburg, Va.

[73] Assignee: Semitool, Inc., Kalispell, Mont.

[21] Appl. No.: 09/056,287

[22] Filed: Apr. 7, 1998

[51] Int. Cl.[6] ..... C23C 22/82

[52] U.S. Cl. ..... 148/272; 148/243; 148/253; 427/318; 427/343; 427/444; 422/19

[58] Field of Search ..... 148/243, 253, 148/272, 287; 427/318, 343, 444; 428/472.2; 422/19

[56] References Cited

U.S. PATENT DOCUMENTS

| | | | |
|---|---|---|---|
| 387,046 | 7/1888 | Breeneman | 148/287 |
| 4,518,440 | 5/1985 | Phillips, Jr. | 428/472.2 |
| 4,636,266 | 1/1987 | Asay | 148/240 |
| 5,139,623 | 8/1992 | Ohmi et al. | 204/129.1 |

OTHER PUBLICATIONS

Miyake et al, "Release Behavior of Metal Ions from Passivated Stainless Steel and Hot Ultra–Pure Water", Feb. 22–23, 1995.

Sato et al, "Deionized Water Heating System with a Passivated Stainless Steel Heater", 12 international symposium on contamination control, Oct. 10–14, 1994.

*Primary Examiner*—John P Sheehan
*Assistant Examiner*—Andrew L. Oltmans
*Attorney, Agent, or Firm*—Rockey, Milnamow & Katz, Ltd.

[57] ABSTRACT

A method for creating an oxide coating on the surface of a component formed from austenitic stainless steel or nickel alloy steel is set forth. The component has a naturally formed oxide film at the surface. The naturally formed oxide is enhanced through a process comprising at least two steps. In the first step, the component is heated in the presence of circulating dry air for a first period of time at a temperature of approximately 300 degrees centigrade. In the second step, the component is heated in the presence of static dry air at an elevated pressure for a second period of time at a temperature that is higher than the temperature during the first period. The exterior portion of the enhanced oxide coating is removed with an oxidizing treatment whereby an oxide coating having a high ratio of chromium to iron is exposed at the surface of the stainless steel.

16 Claims, 5 Drawing Sheets

TRACE METALS RELEASE (ppb) IN 18 MEGOHM D.I. WATER, 168 HRS @ 80 DEG C

TRACE METALS RELEASE (ppb) IN ACT 935, 168 HRS @ 80 DEG C

TRACE METALS RELEASE (ppb) IN ACT 690C, 168 HRS @ 95 DEG C

METHOD FOR DEVELOPING AN ENHANCED OXIDE COATING ON A COMPONENT FORMED FROM STAINLESS STEEL OR NICKEL ALLOY STEEL

BACKGROUND OF THE INVENTION

The present invention relates to a method for creating an oxide coating on certain metals wherein the oxide coating is highly resistant to corrosion and ionic leaching. More particularly, this invention relates to a method for creating a protective coating on the surface of austenitic stainless steel or nickel alloy steel. The oxide coating is both resistant to corrosion and to leaching of molecules from the steel into material that is in contact with the metal.

Austenitic stainless steel and nickel alloy steel are commonly used for piping, vessels, and equipment used in processes in which the purity of the material being processed is a critical consideration. Such steels are also used in processes in which a strong solvent or other corrosive material is present. Many such processes are carried out at elevated temperatures. The presence of very pure materials, strong solvents, or corrosive materials, particularly at elevated temperatures, makes prevention of corrosion of the steel and/or control of infusion of various contaminating components from the steel difficult. Examples of processes for which prevention of corrosion, control of infusion, or both are critical considerations include chemical, food, pharmaceutical, and semiconductor processing.

Components used for such processes are generally polished to eliminate small surface protrusions from which ions may leach into the material being processed, or which may provide locations at which corrosion may begin. The oxide coating that naturally forms on the surfaces of austenitic stainless steels and nickel alloy steel is inadequate in many applications to prevent corrosion or unacceptable leaching of ions from the steel into material in contact with steel, particularly when the components are irregularly shaped or contain welds.

The oxide film that naturally forms on austenitic stainless steel and on nickel alloy steel contains both iron and iron oxides as well as chromium and chromium oxides. Oxide films that have a high ratio of chromium-to-iron have resistance to leaching that is superior to that of films having a lower chromium-to-iron ratio. Existing methods for enhancing the oxide film are not able to reliably create oxide films on austenitic stainless steel and nickel alloy steel components which have acceptable performance or durability in difficult applications. This is particularly true when the existing methods are applied to components having surface irregularities such as crevices of sharp angles and those formed by welding.

BRIEF SUMMARY OF THE INVENTION

In accordance with the present invention, disadvantages of existing processes for creating an oxide film on austenitic stainless steel and nickel alloy steel and the inadequacies of oxide film created by those processes have been overcome. An oxide film is created that is high in chromium including chromium oxides and chromium hydroxide. The oxide film, because of the high chromium content, is highly resistant to corrosion and ionic leaching.

A method for creating an oxide coating on the surface of a component formed from austenitic stainless steel or nickel alloy steel is set forth. The component has a naturally formed oxide film at the surface. The naturally formed oxide is enhanced through a process comprising at least two steps. In the first step, the component is heated in the presence of circulating dry air for a first period of time at a temperature of approximately 300 degrees centigrade. In the second step, the component is heated in the presence of static dry air at an elevated pressure for a second period of time at a temperature that is higher than the temperature during the first period. The exterior portion of the enhanced oxide coating is removed with an oxidizing treatment whereby an oxide coating having a high ratio of chromium to iron is exposed at the surface of the stainless steel.

Accordingly, an object of the present invention is to provide a method for creating an oxide coating on the surface of austenitic stainless steel and on nickel alloy steel that is more effective in preventing leaching of iron into material adjacent to the steel than films developed by known methods.

Another object of the present invention is to provide a method for creating an oxide film on the surface of austenitic stainless steel and on nickel alloy steel that provides better resistance to corrosion than films developed by known methods.

Yet another object of the present invention is to provide a method for creating an oxide film on the surface of austenitic stainless steel and on nickel alloy steel that will create an oxide film on irregular surfaces that effectively prevents leaching of ions into material adjacent to the surface.

A further object of the present invention is to provide a method for creating an oxide film on the surface of austenitic stainless steel and on nickel alloy steel which has been welded.

These and other objects and advantages of the present invention, as well as details of the preferred embodiment thereof, will be more fully understood from the following description and the drawings.

DETAILED DESCRIPTION OF THE INVENTION

Figure 1:
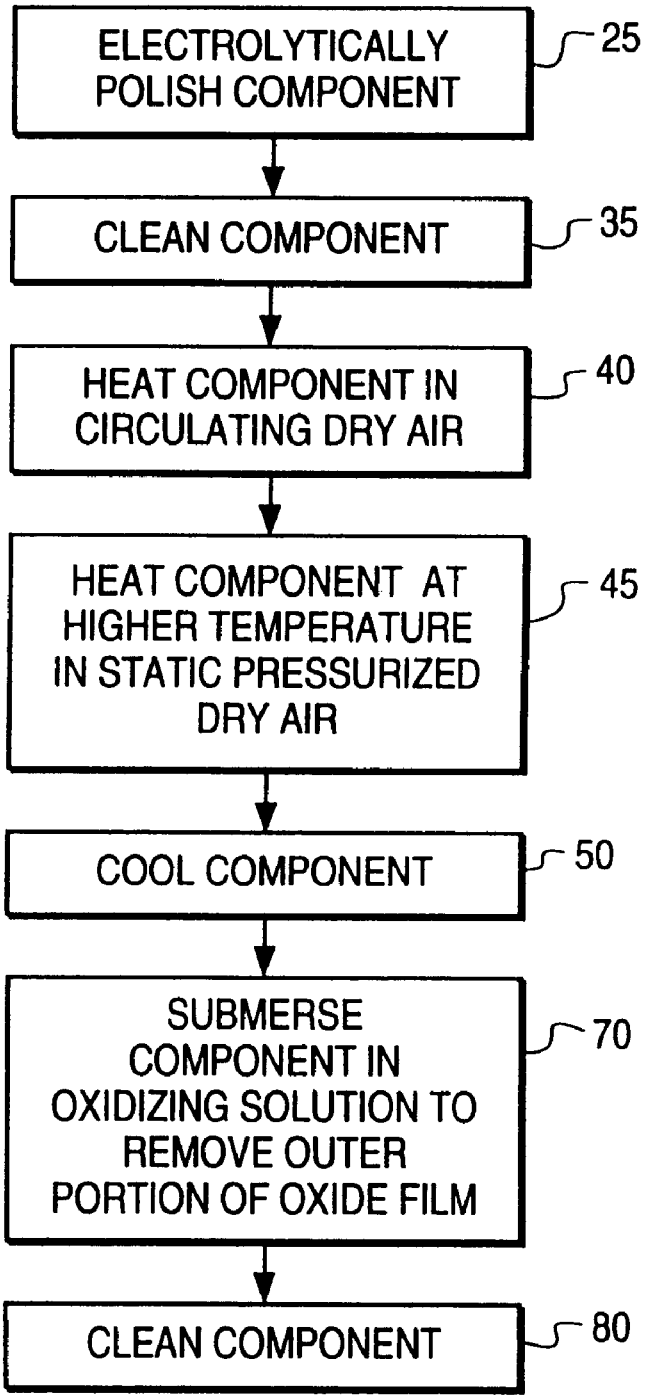
FIG. 1 is a flow chart illustrating the steps for practicing one embodiment of the method of the present invention.

The generalized steps of a method for developing an enhanced oxide coating of an austenitic stainless steel and nickel alloy steel according to one embodiment of the present invention are depicted by the flow chart of FIG. 1.

These steps are preferably practiced on components fabricated from austenitic stainless steel or nickel alloy steel by conventional manufacturing processes to the desired dimensions and configuration. A cross-sectional illustration of a component formed from austenitic stainless steel is illustrated in FIG. 2.

Figure 2:
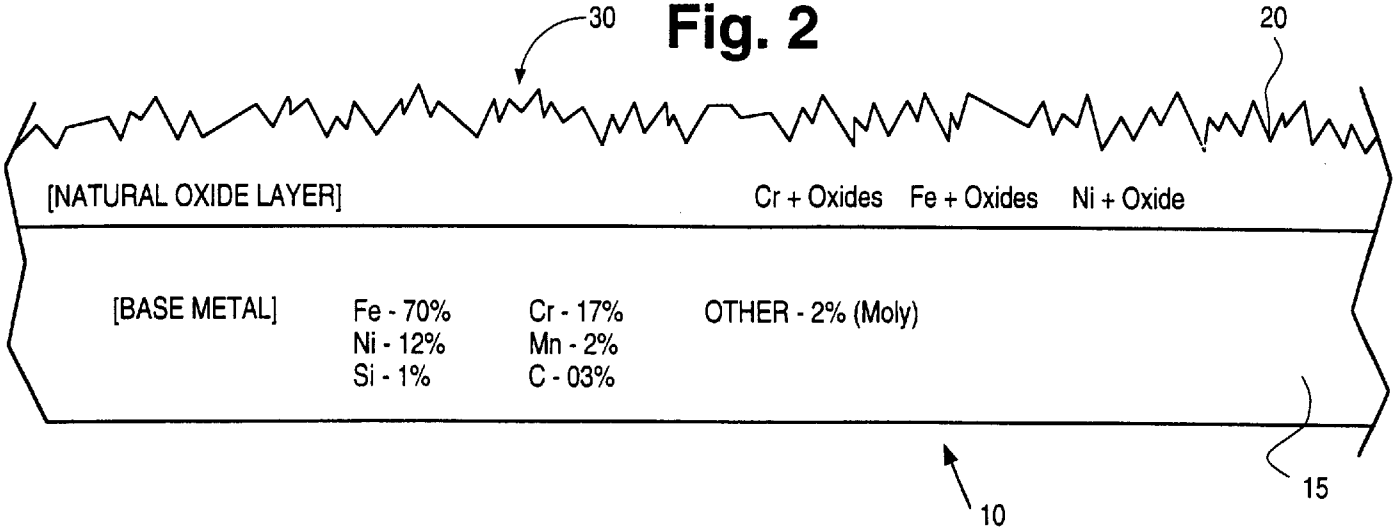
FIG. 2 is a cross-sectional illustration of an austenitic stainless steel base metal and the oxide film that naturally forms on the surface thereof.

As shown in FIG. 2, the component, shown generally at 10, is comprised of a base metal layer 10 having an exteriorly disposed natural oxide layer 20. The base metal layer 10 has a chemical composition common to austenitic steel. The oxide film 20 forms naturally on austenitic stainless steel after the manufacture of the component 10. The surface of the natural oxide film 20 is irregular and the material present in the film is distributed randomly.

Figure 3:
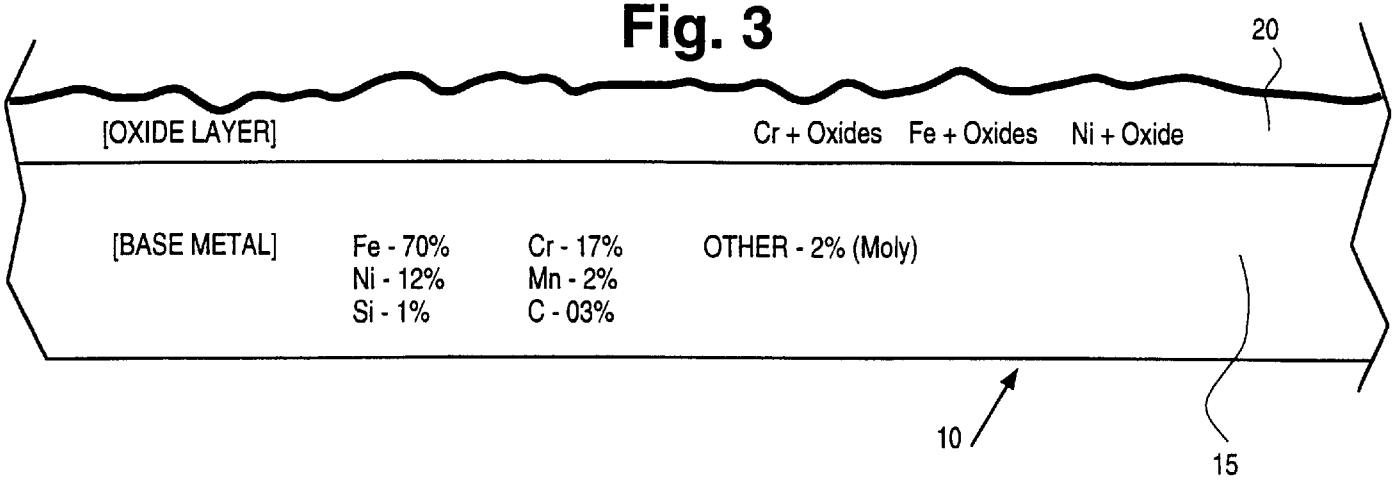
FIG. 3 is a cross-sectional illustration of the stainless steel and oxide film of FIG. 2 after the surface of the oxide film has been electrolytically polished.

With reference to FIG. 1, the component 10 is first subject to an electrolytic polish step 25. In this step, the component may be electrolytically polished by any well known method to smooth the outer surface of the oxide film 20. FIG. 3 illustrates the stainless steel and film of FIG. 2 after electrolytic polishing. As shown in FIG. 3, the electrolytic polish step 25 smoothes the micro-fissures 30 that were present in the oxide layer 20. Such micro-fissures 30 are often generated during cold working of the component 10.

The component is thereafter cleaned to remove all surface contaminants at step 35 of FIG. 1. In accordance with one embodiment of the cleaning step 35, cleaning is preferably done first in an agitated acid bath of, for example, citric acid at a ten percent concentration. The component 10 is preferably subject to this process for approximately thirty minutes. The component 10 is then removed from the bath and the acid on the component is neutralized and removed from the component by a spray of deionized water. A compressed air spray may then be used to remove water from crevices and concealed areas. The component is then wiped with deionized water to remove water marks, and, then wiped with methanol. If any surface contaminants remain, these steps, beginning with electrolytic polishing, are repeated.

Detection of surface contaminants may be undertaken using any one of a number of different methods. For example, surface contaminants may be detected by measuring the resistivity on the input side of a rinsing stream and comparing that with the resistivity of the stream at the output side. When the measurement values are substantially equal, surface contaminants are considered to be removed. Similarly, the specific gravity of the fluid on the input side and on the output side may be used for such measurements.

When all surface contaminants have been removed as described above, methanol residue is then removed by deionized water spray. The component 10 is then submersed in a circulating bath of 15 to 18 Megohm deionized water for approximately eight to twelve hours. The time required depends on the complexity of the component and irregularity of its surface. Components having more irregular surfaces require more time in the circulating bath. The component 10 is then removed from the circulating bath and a compressed air spray may then be used to remove water from crevices and concealed areas. The component 10 is again wiped with deionized water to remove water marks.

After the cleaning step 35, the component 10 undergoes one or more processes by which the surface oxide layer 20 is enhanced. In accordance with one embodiment of the process, two elevated temperature oxide enhancement steps are employed. These steps are illustrated at steps 40 and 45 of FIG. 1.

In a preferred implementation of step 40, the component 10 is placed in an oven which is heated, for example, to 250 to 300 degrees centigrade. Moisture is removed from the atmosphere in the oven by purging the oven with Clean Dry Air circulated into the oven at a rate that is determined by the oven capacity or volume in cubic feet. As an example, if the oven has a capacity of 50 cubic feet, the flow rate should be set substantially to 50 cubic feet per hour. In the disclosed embodiment, this flow is used to evacuate or purge all of the ambient air and that is inside the oven at the beginning of the process. Clean Dry Air refers to air that has a dew point that is not higher than about—100 degrees Fahrenheit. After a predetermined period of time of, for example, one hour, the circulation of Clean Dry Air is stopped and the component 10 is subject to oxide layer enhancement at step 45 of FIG. 1. In step 45, the temperature of the oven is elevated to a higher temperature than that used in step 40. In a preferred embodiment, the temperature of the oven is increased, for example, to approximately 425 degrees centigrade. The temperature of 425 degrees centigrade has been found to avoid the loss of chromium in the heat affected zone of welds in welded stainless steel components. The pressure of the Clean Dry Air within the oven is preferably maintained at approximately one and one half inches water column. The component remains in the oven at this temperature and pressure for a predetermined period of time of, for example, approximately 2 hours. The oven and component 10 are then cooled.

Figure 4:
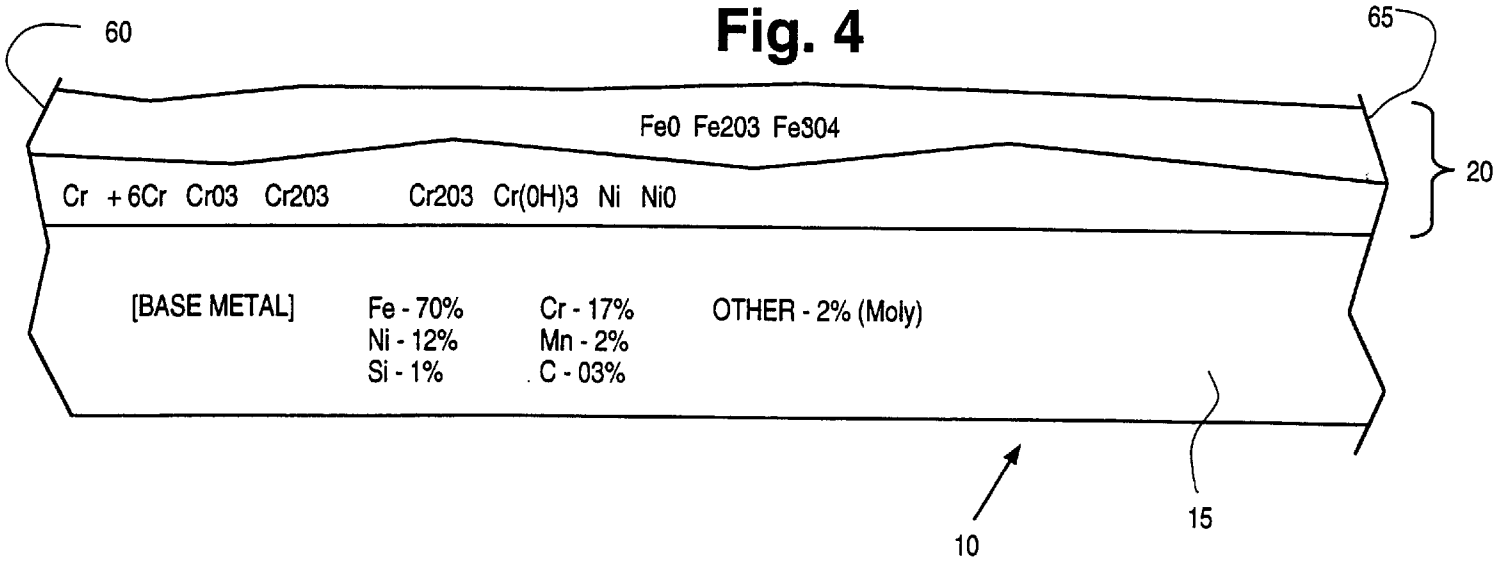
FIG. 4 is a cross-sectional illustration of the stainless steel and oxide film of FIG. 3 after the film has been subject to a first enhancement step.

FIG. 4 illustrates the layer composition of the components 10 after the oxide layer enhancement steps. As shown, the oxide layer 20 is generally comprised of an outer layer region 60 having a high iron content and low chromium content and an interior layer region 65 having a high chromium content. The resulting layer is enhanced in this dual enhancement process even in those regions of the component having crevices and welds.

While the component is heated in the dry atmosphere, the oxide film 20 that had naturally formed on austenitic stainless steel or nickel alloy steel from which the component is fabricated becomes thicker. In addition to becoming thicker, iron and iron oxides in the oxide film accumulate near the outer surface of the film to form layer 60 thereby giving the film a light gold appearance. The film layer 65 has more chromium and a higher ratio of chromium and chromium compounds to iron and iron oxides than does the portion of the film 60 adjacent to the outer surface of the film.

After the part has cooled, it is subject to an oxidation treatment at step 70 of FIG. 1. The oxidation treatment is used to remove the outer portion 60 of the oxide film 20 containing the accumulated iron. In accordance with one embodiment of the oxidation treatment, the component 10 is immersed in a circulating bath of an oxidizing agent at an elevated temperature. For example, a ten percent solution of phosphoric acid ($H_3PO_4$) at a temperature generally in the range of 38 to 43 degrees centigrade may be employed. Oxidizing agents that have also been found to be effective include 50 ppm chlorine, nitric acid, $H_2O_2$, potassium permanganate, and hydrochloric acid. The component 10 preferably remains in the circulating bath until the light gold color is no longer visible on the surface of the component.

Figure 5:
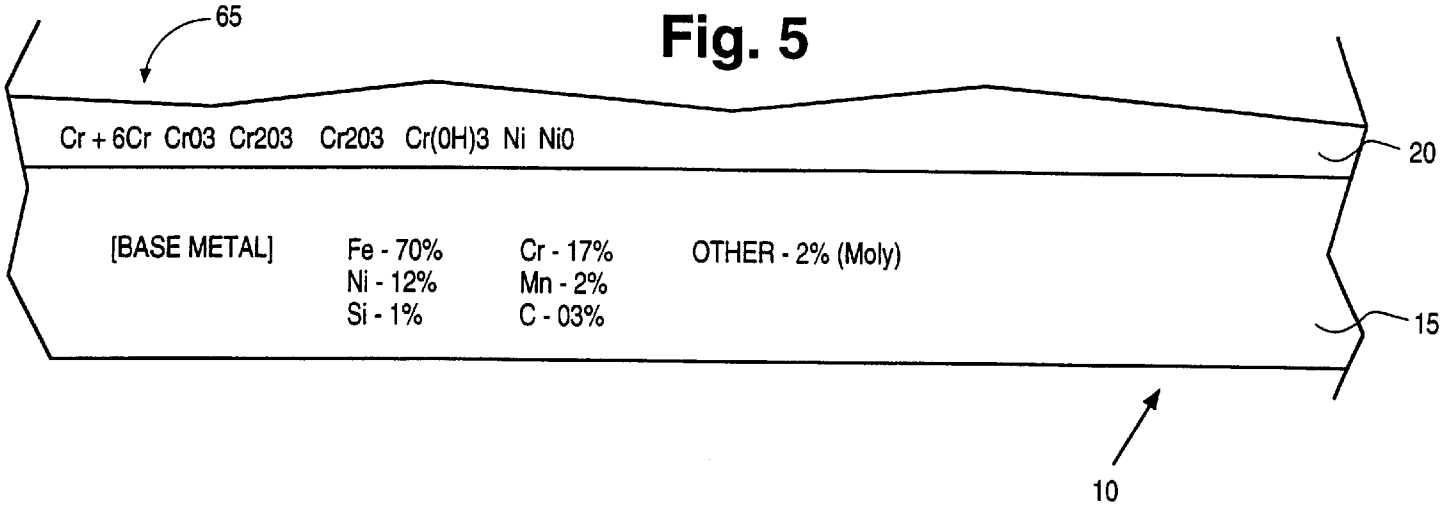
FIG. 5 is a cross-sectional illustration of the stainless steel and oxide film of FIG. 4 after the film has been subjected to an oxidizing treatment according to the present invention.

FIG. 5 illustrates the result of an oxidation treatment on the film illustrated by FIG. 4. As illustrated, the oxide layer 20 is now principally comprised of the chromium containing layer 65. This chromium containing layer provides the requisite protection to the component 15.

The component is then removed from the oxidizing bath and cleaned at step 80 of FIG. 1. In the cleaning step 80, the material used for oxidizing treatment is neutralized and removed from the component by a spray of deionized water. Compressed air spray may then be used to remove water from crevices and concealed areas. The component is then wiped with deionized water to remove water marks.

The effectiveness of the film developed by this method for preventing leaching and corrosion for an austenitic stainless steel was tested under three conditions. Specimens of 316 L stainless steel were prepared by electrolytically polishing and other specimens were prepared in accordance with the present invention. The test specimens were sheared from flat 316L stainless steel sheets and had a dimension of 2"×0.750"×0.060".

The first test was conducted by immersing a specimen prepared by each method for 168 hours in 18 megohm deionized water which was maintained at 80 degrees centigrade. The water in which each specimen was immersed was analyzed for trace metals from the specimen. The amount of chromium, iron, nickel, and manganese, in parts per billion, detected in the water used to test each specimen is set forth below.

| | Electrolytically Polished Specimen | Specimen Prepared According to the Invention |
|---|---|---|
| Chromium | 80 | 19 |
| Iron | 600 | 92 |
| Nickel | 30 | undetectable |
| Manganese | 9 | 3 |

Figure 6:
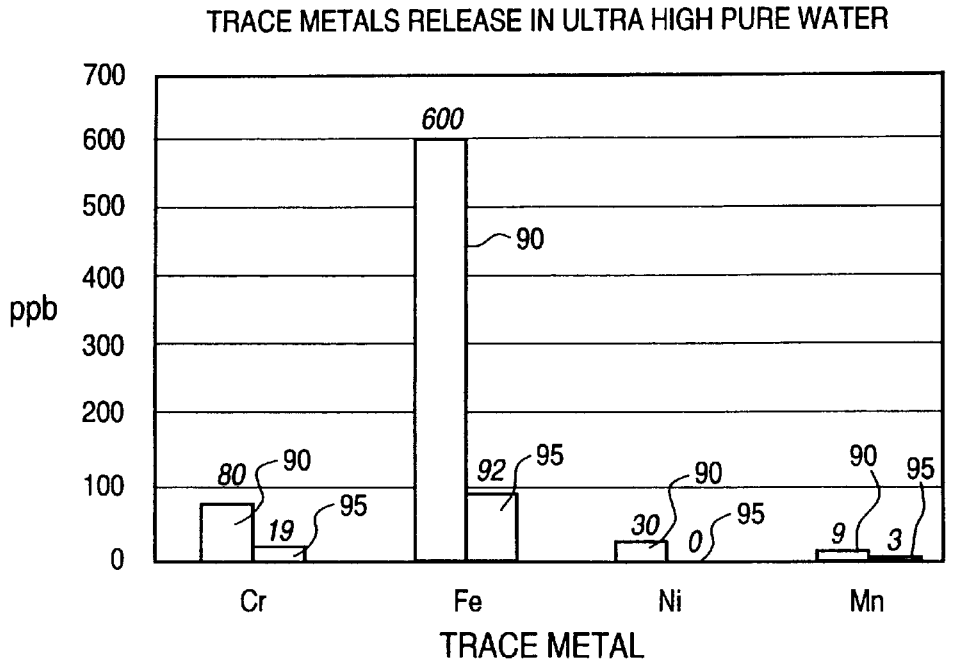
FIG. 6 is a chart showing the trace metals found in deionized water after exposure to test specimens.

These results are depicted by the bar charts of FIG. 6 wherein each bar designated at 90 corresponds to an untreated component and each bar designated at 95 corresponds to a component treated in the foregoing manner. Such designations are also used in FIGS. 7 and 8.

The second test was conducted by immersing a specimen prepared by each method for 168 hours in solvent supplied by Ashland Chemical Company and designated ACT 935 was maintained at 80 degrees centigrade. This solvent is designated a solvent stripper and is used to remove positive photoresist layers in the production of semiconductor wafers. The solvent in which each specimen was immersed was analyzed for trace metals from the specimen. The amount of chromium, iron, nickel, and manganese, in parts per billion, detected in the solvent used to test each specimen is set forth below.

| | Electrolytically Polished Specimen | Specimen Prepared According to the Invention |
|---|---|---|
| Chromium | 275 | 59 |
| Iron | 1064 | 244 |
| Nickel | 137 | 7 |
| Manganese | 34 | undetectable |

Figure 7:
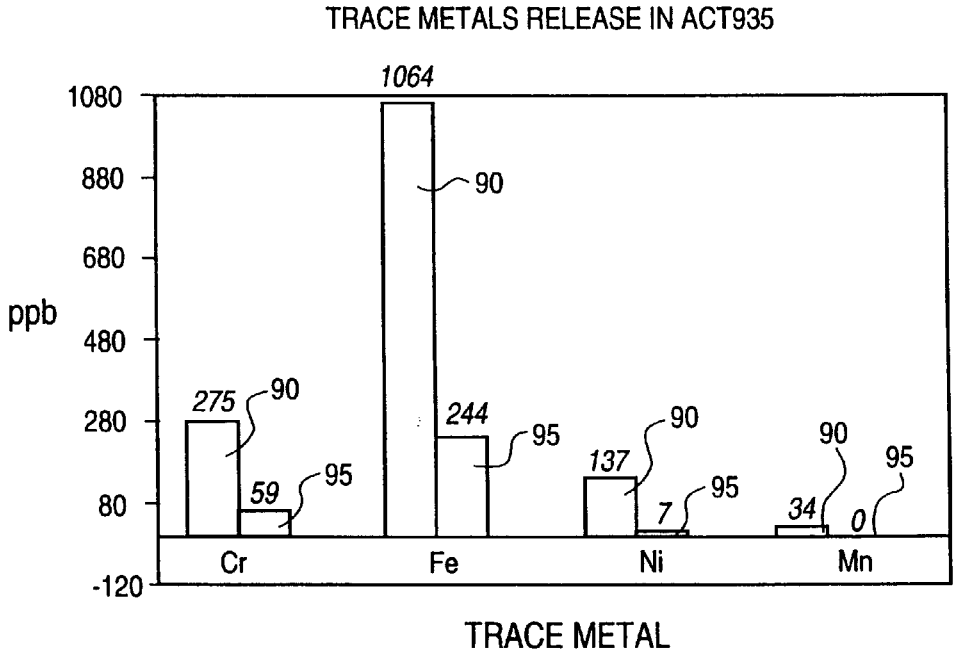
FIG. 7 is a chart showing the trace metals found in a solvent after exposure to test specimens.
Figure 8:
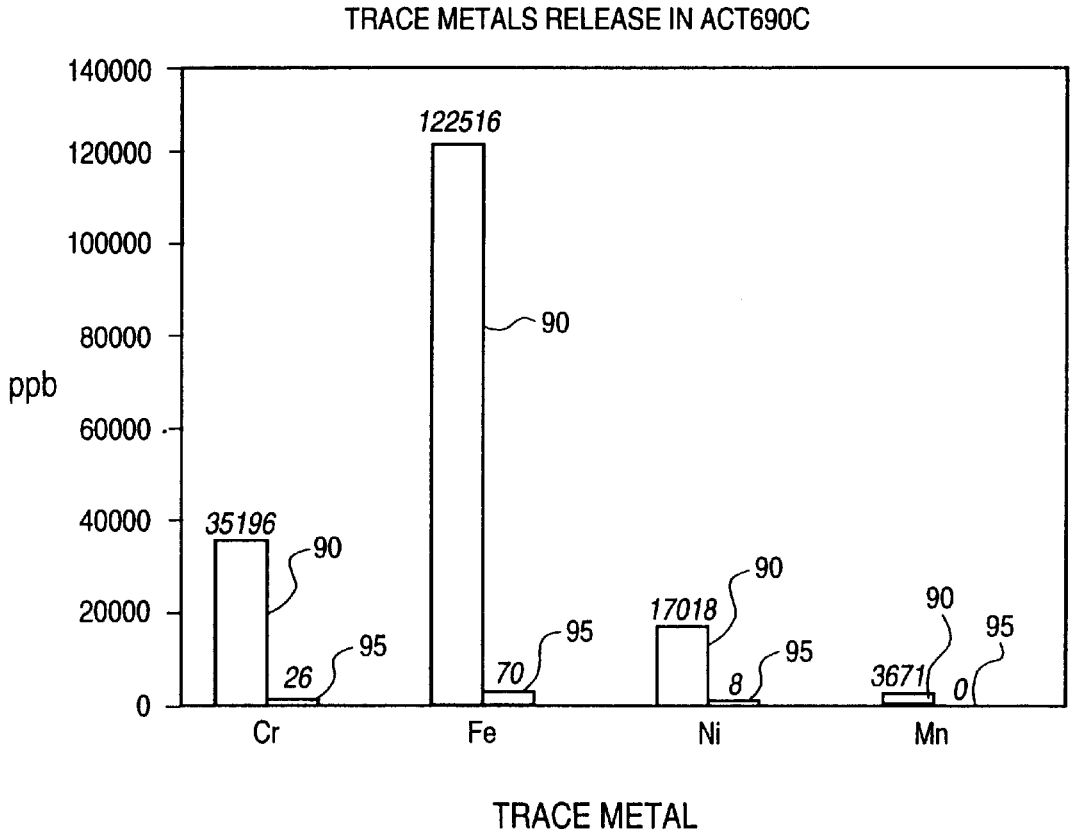
FIG. 8 is a chart showing the trace metals found in a solvent after exposure to test specimens.

These results are depicted by the bar charts of FIG. 7.

The third test was conducted by immersing a specimen prepared by each method for 168 hours in solvent supplied by Ashland Chemical and designated ACT 690C was maintained at 95 degrees centigrade. This solvent is designated a solvent stripper and is used for polymer removal to strip away etch residue in the production of semiconductor wafers. The solvent in which each specimen was immersed was analyzed for trace metals from the specimen. The amount of chromium, iron, nickel, and manganese, in parts per billion, detected in the solvent used to test each specimen is set forth below.

| | Electrolytically Polished Specimen | Specimen Prepared According to the Invention |
|---|---|---|
| Chromium | 35196 | 26 |
| Iron | 122516 | 70 |
| Nickel | 17018 | 8 |
| Manganese | 3671 | undetectable |

These results are depicted by the bar charts of FIG. 7.

These tests demonstrate the effectiveness of the present invention for creating a film that provides a significantly more effective barrier between an austenitic stainless steel or nickel alloy steel and solutions with which such steels are in contact in various applications.

Numerous modifications may be made to the foregoing system without departing from the basic teachings thereof. Although the present invention has been described in substantial detail with reference to one or more specific embodiments, those of skill in the art will recognize that changes may be made thereto without departing from the scope and spirit of the invention as set forth in the appended claims.

We claim:

1. A method for creating an oxide coating on the surface of a component formed from austenitic stainless steel or nickel alloy steel, the component having a naturally formed oxide film at the surface, the method comprising the steps of:

enhancing the naturally formed oxide film on the surface by heating the surface in the presence of circulating dry air for a first period of time at a temperature of approximately 300 degrees centigrade;

heating the surface in the presence of static dry air at an elevated pressure for a second period of time at a temperature that is higher than the temperature during the first period; and removing an exterior portion of the enhanced oxide coating with an oxidizing treatment whereby an oxide coating having a high ratio of chromium to iron is exposed at the surface of the steel.

2. The method of claim 1 wherein the first period of time is approximately one hour.

3. The method of claim 1 wherein the temperature during the second period of time is approximately 425 degrees centigrade.

4. The method of claim 2 wherein the temperature during the second period of heating is approximately 425 degrees centigrade.

5. The method of claim 1 wherein the second period of time is approximately two hours.

6. The method of claim 2 wherein the second period is approximately two hours.

7. The method of claim 3 wherein the second period is approximately two hours.

8. The method of claim 4 wherein the second period is approximately two hours.

9. The method of claim 1 wherein the elevated pressure is approximately one and one half inches water column.

10. The method of claim 3 wherein the elevated pressure is approximately one and one half inches water column.

11. The method of claim 5 wherein the elevated pressure is approximately one and one half inches water column.

12. The method of claim 7 wherein the elevated pressure is approximately one and one half inches water column.

13. The method of claim 1 wherein the oxidizing treatment comprises submersing the surface in a solution of approximately ten percent phosphoric acid.

14. The method of claim 3 wherein the oxidizing treatment comprises submersing the surface in a solution of approximately ten percent phosphoric acid.

15. The method of claim 7 wherein the oxidizing treatment comprises submersing the surface in a solution of approximately ten percent phosphoric acid.

16. The method of claim 9 wherein the oxidizing treatment comprises submersing the surface in a solution of approximately ten percent phosphoric acid.

* * * * *